US006622717B1

(12) United States Patent
Kim

(10) Patent No.: US 6,622,717 B1
(45) Date of Patent: Sep. 23, 2003

(54) OVER-THE-RANGE HOOD

(75) Inventor: Gong-Soo Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/242,458

(22) Filed: Sep. 13, 2002

(30) Foreign Application Priority Data

Jun. 14, 2002 (KR) ..... 2002-33084

(51) Int. Cl.[7] ..... F24C 15/20
(52) U.S. Cl. ..... 126/299 D; 126/299 R
(58) Field of Search ..... 126/299 R, 299 D, 126/299 C, 300–303, 21 R, 307 R, 312; 55/DIG. 36; 454/67; D23/372

(56) References Cited

U.S. PATENT DOCUMENTS 931,312 A * 8/1909 Kahn ..... 126/299 D
2,341,245 A * 2/1944 Sonntag ..... 126/299 D
3,031,946 A * 5/1962 Watt et al. ..... 126/299 D
6,291,809 B1 9/2001 Ha
6,470,880 B1 * 10/2002 Chang ..... 126/299 D

FOREIGN PATENT DOCUMENTS

JP 2-286101 * 11/1990 ..... 126/299 R
JP 6-137629 * 5/1994 ..... 126/299 R

OTHER PUBLICATIONS

U.S. patent application Ser. No. 10/225,344, Kim, filed Aug. 23, 2002, Samsung Electronics Co. Ltd.

* cited by examiner

*Primary Examiner*—James C. Yeung
(74) *Attorney, Agent, or Firm*—Staas & Halsey LLP

(57) ABSTRACT

An over-the-range hood covering a larger space above a gas range to efficiently discharge fumes, oil droplets and odors generated from the gas range to outside of a room is provided, in which a pair of guide rods is included, each of which is coupled to respective side plates of the over-the-range hood by a pivot to be rotated forwardly, and a pair of wing plates rotatably connected to the pair of guide rods respectively by a holding unit. The over-the-range hood enables an amount of odors, fumes and oil droplets diffused into the room to be minimized, thereby maintaining pleasant room air.

23 Claims, 8 Drawing Sheets

OVER-THE-RANGE HOOD

CROSS-REFERENCE TO RELATED APPLICATIONS

This application claims the benefit of Korean Application No. 2002-33084, filed Jun. 14, 2002, in the Korean Industrial Property Office, the disclosure of which is incorporated herein by reference.

BACKGROUND OF THE INVENTION

1. Field of the Invention

The present invention relates to an over-the-range hood which is adapted to discharge oil droplets, odors and the like generated from a gas range disposed therebelow while cooking food on the gas range, and more particularly, to an over-the-range hood which is provided with wing plates preventing oil droplets, odors and the like generated from a gas range from diffusing in a room.

2. Description of the Related Art

In general, an over-the-range hood is an appliance for discharging various oil droplets, odors and the like generated from a gas range to outside of a room while cooking food on the gas range. The conventional over-the-range hood will now be described with reference to FIGS. 1 and 2.

FIG. 1 is a front elevation view showing a conventional over-the-range hood disposed over a gas range, and FIG. 2 is a side elevation view of the conventional over-the-range hood of FIG. 1.

As shown in FIGS. 1 and 2, pots 103 are placed on a gas range 102. When cooking is carried out by the gas range 102, various odors and oil droplets 104 are inevitably generated from the pots 103. To discharge the odors and oil droplets 104 to outside of the room, an over-the-range hood 101 is provided over the gas range 102. The over-the-range hood 101 is provided therein with a blower fan (not shown) to discharge various odors and oil droplets 104 generated from the pots 103, and a fan motor (not shown) driving the blower fan, so that various odors and oil droplets 104 can be discharged to the outside of the room through a ventilation duct 201 (shown in FIG. 2).

However, the above-described conventional over-the-range hood has disadvantages as follows. The disadvantages in the conventional over-the-range hood will be disclosed with reference to FIG. 2.

A gas range is equipped at a top of the gas range with a gas range part 202, which is comprised of two pairs of top burners, i.e., a front pair of top burners 202*b* and a rear pair of top burners 202*a*, in order to cook several kinds of food simultaneously. In the gas range, the front pair of top burners 202*b* is positioned forwardly from a front face of the over-the-range hood when viewed from the side. In this case, as shown in FIG. 2, although various odors, oil droplets and the like 104*a* generated from the rear pair of top burners 202*a* can be easily discharged to the outside of the room through an intake port 203 of the over-the-range hood 101, odors, oil droplets and the like 104*b* generated from the front pair of top burners 202*b* vertically rise and diffuse into the room without being sucked into the over-the-range hood 101. Consequently, room air cannot be maintained in a pleasant condition due to contamination by odors and oil residue from odors, oil droplet and the like 104*b*.

SUMMARY OF THE INVENTION

Accordingly, an over-the-range hood, which is adapted to discharge oil droplets, odors and the like generated from a gas range disposed therebelow, is provided.

Additional objects and advantages of the invention will be set forth in part in the description which follows and, in part, will be obvious from the description, or may be learned by practice of the invention.

In order to accomplish the above object, an over-the-range hood adapted to discharge odors and undesired substances generated from ranges to the outside of the room at a time of cooking by a gas range, comprising: a pair of guide rods coupled to both side plates of the over-the-range hood by a pivot to be rotated forwardly; and a pair of wing plates connected to the pair of guide rods respectively, and adapted to be rotated toward each other about the pair of guide rods by a holding unit.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
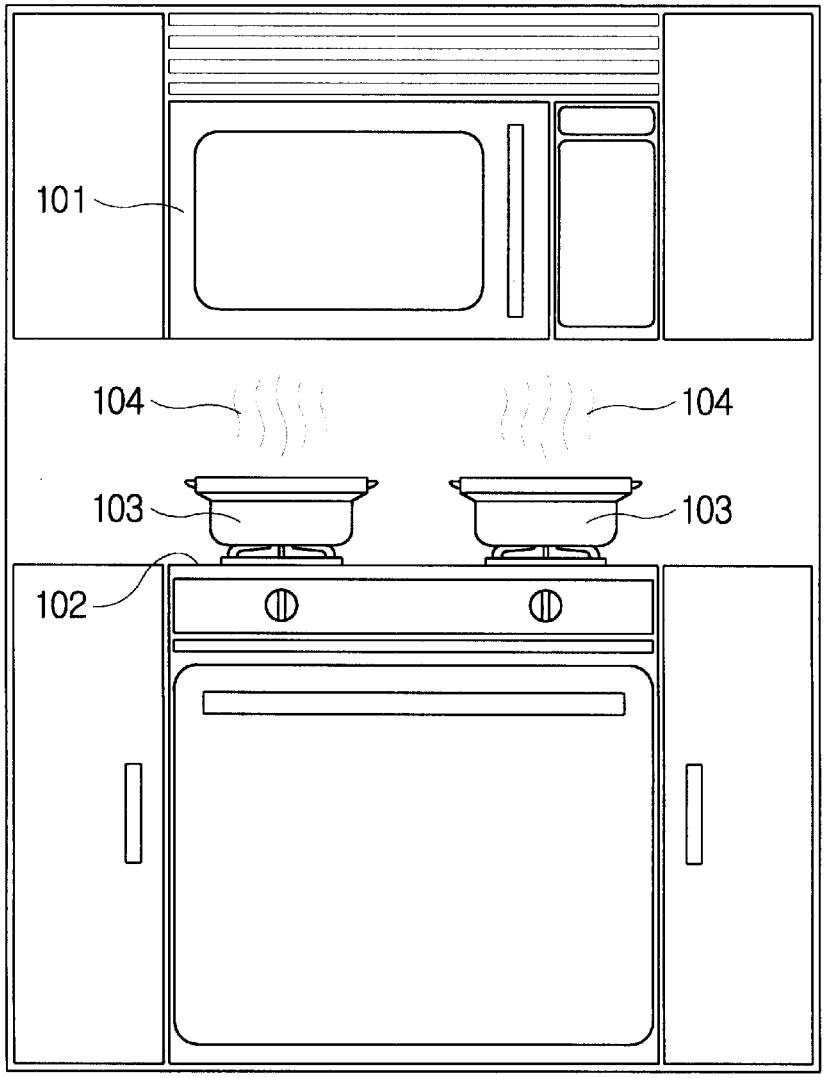
FIG. 1 (PRIOR ART)
FIG. 1 is a front elevation view showing a conventional over-the-range hood disposed over a gas range.
Figure 2:
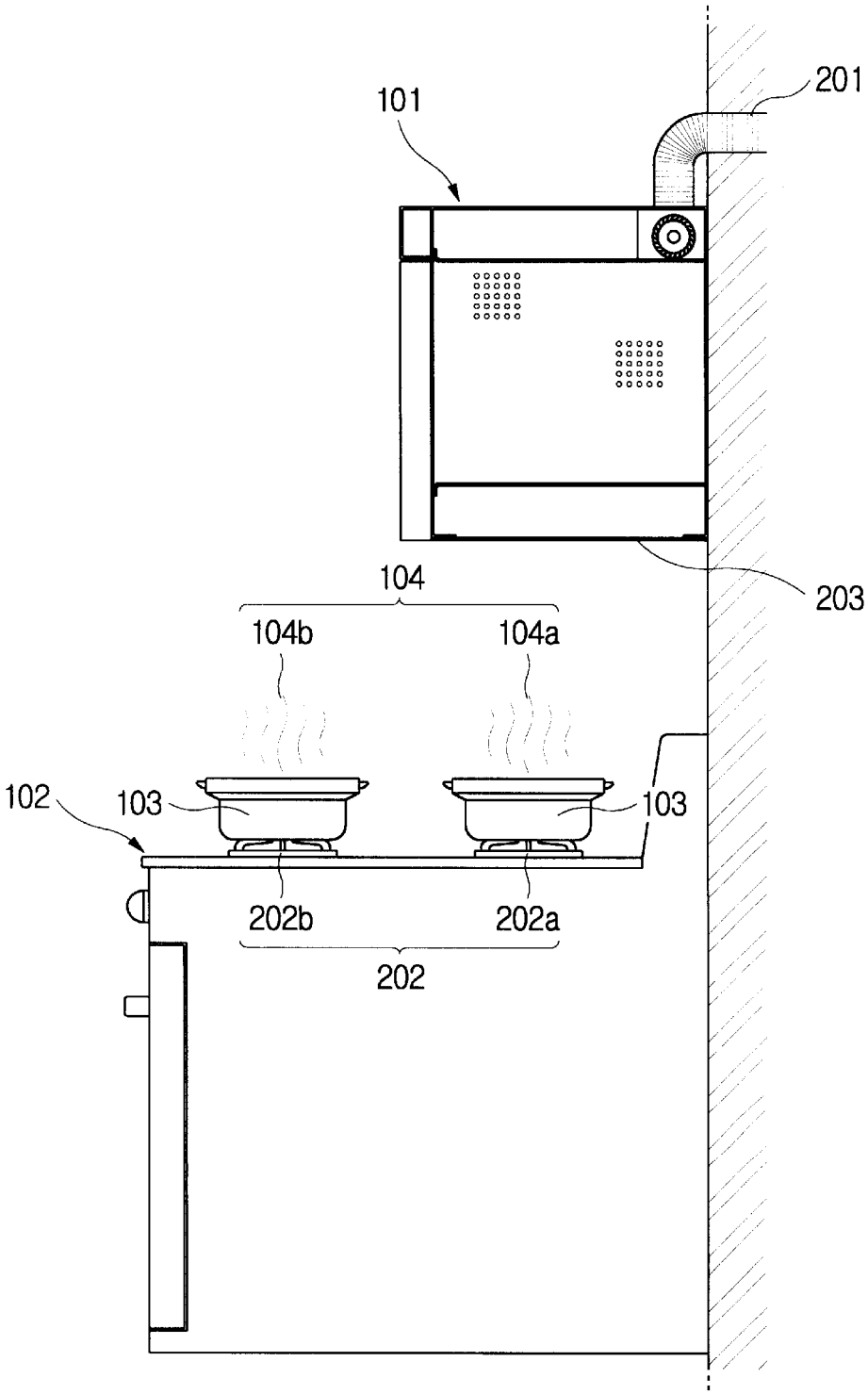
FIG. 2 (PRIOR ART)
FIG. 2 is a side elevation view of the conventional over-the-range hood of FIG. 1.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
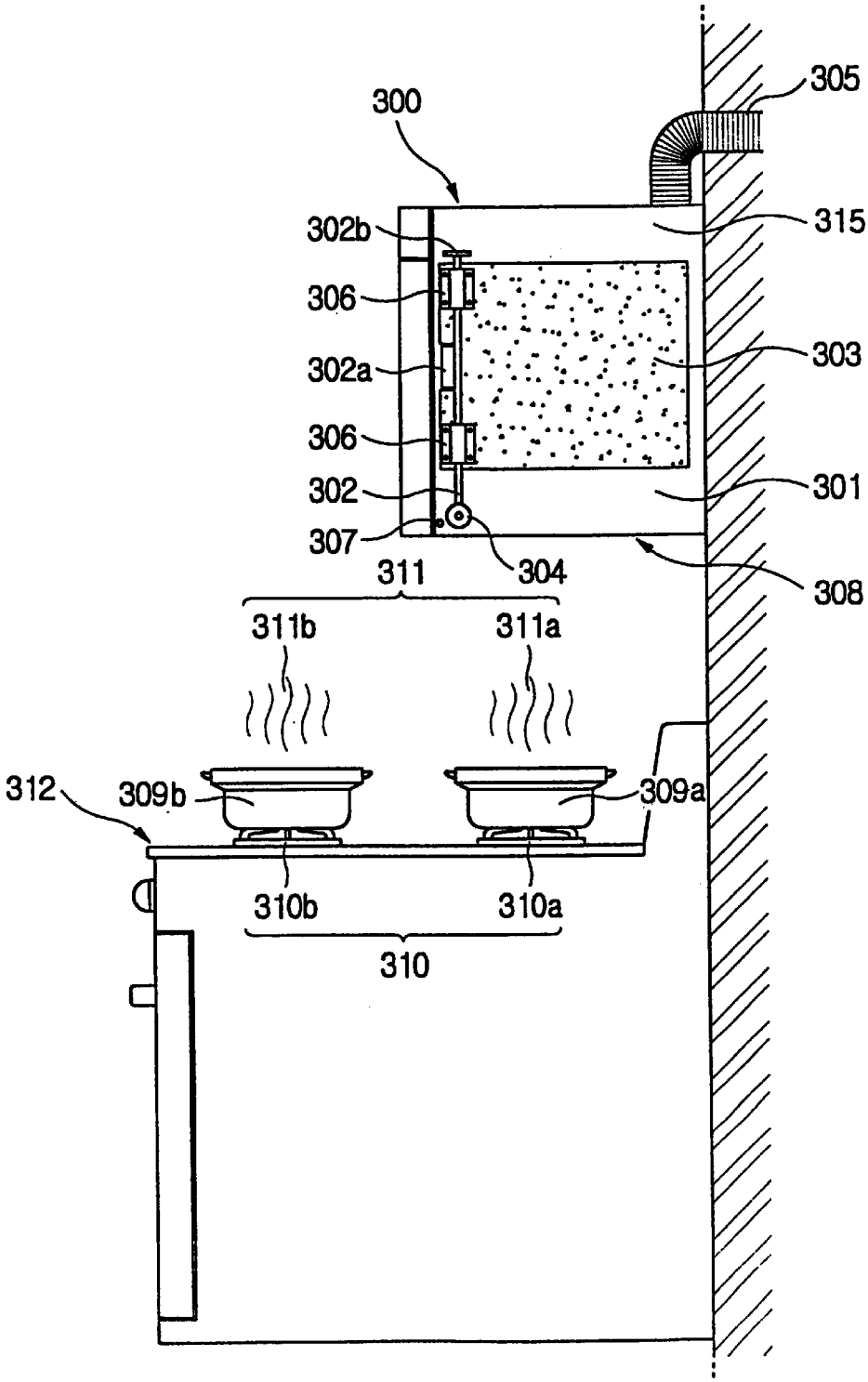
FIG. 3 is a side elevation view of an over-the-range hood according to an embodiment of the present invention, which is disposed over a gas range.
Figure 4C:
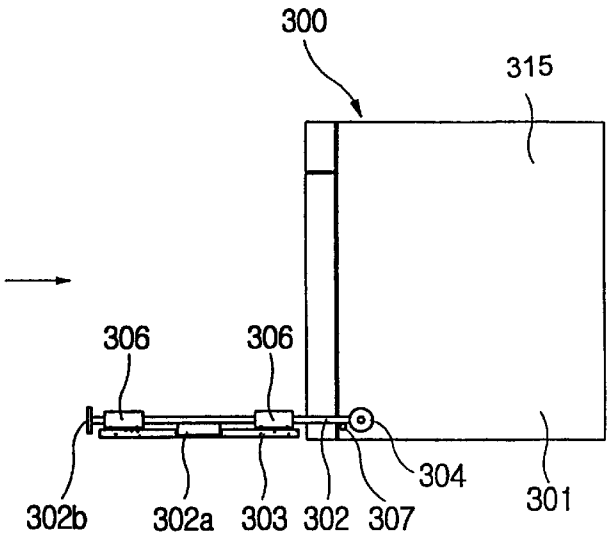
FIGS. 4A–4C are side views showing an extending operation of guide rods and wing plates according to FIG. 3.
Figure 4B:
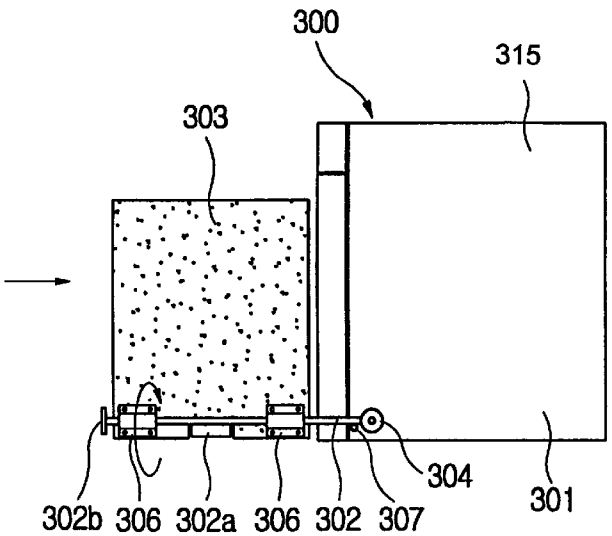
Figure 4A:
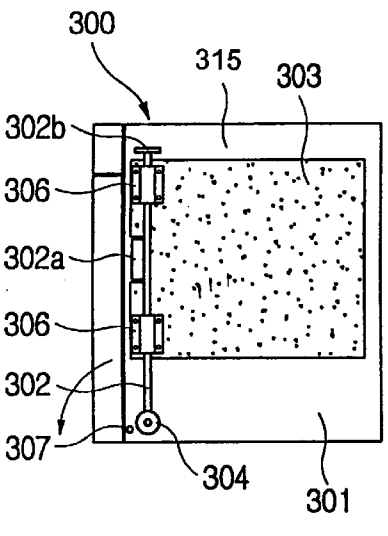
Figure 5:
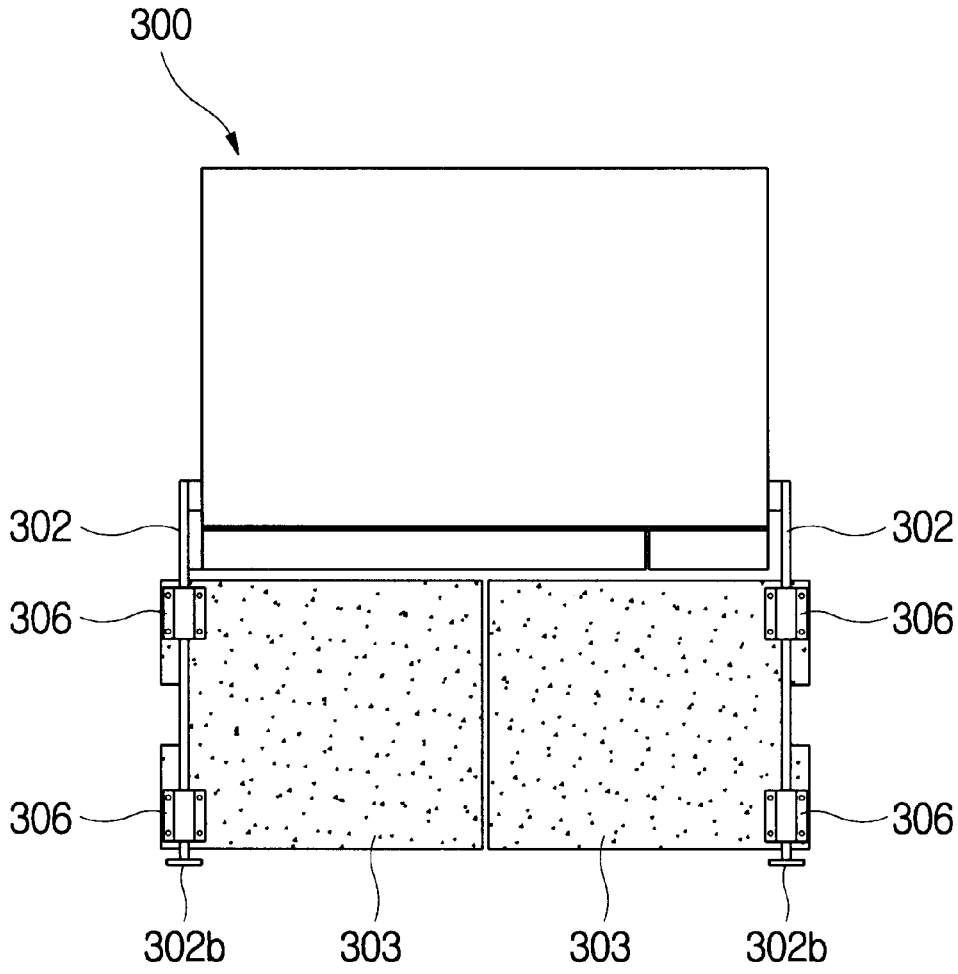
FIG. 5 is a schematic plan view of the over-the-range hood according to FIG. 3.
Figure 6:
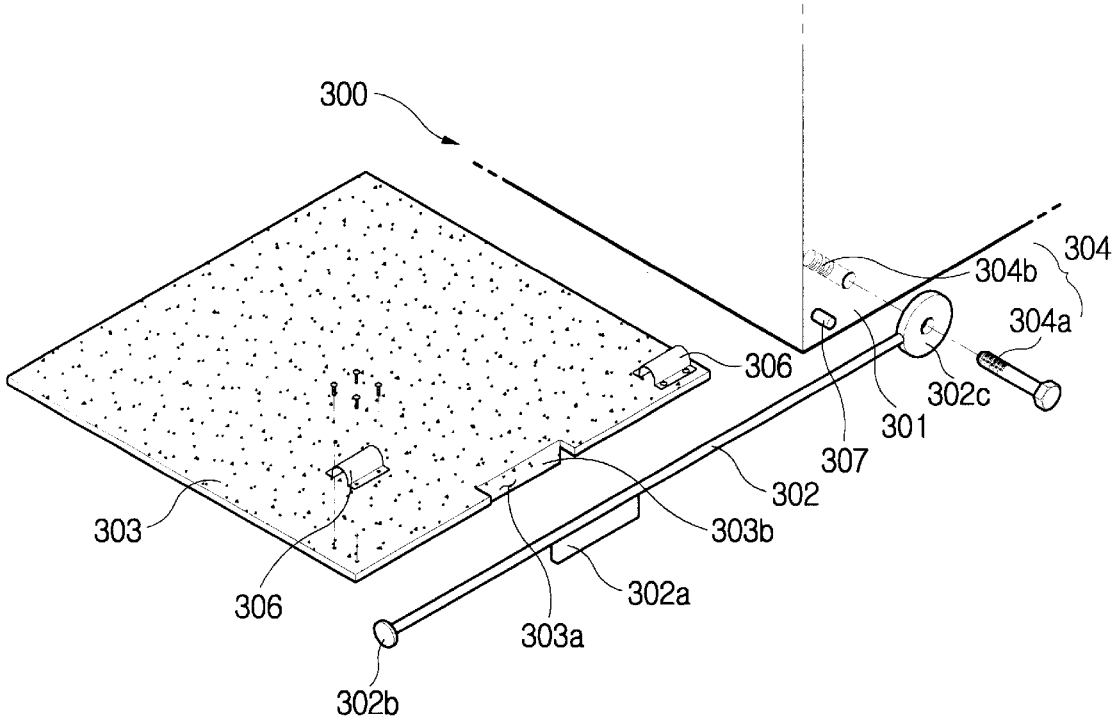
FIG. 6 is an exploded perspective view of coupling structures according to FIG. 3.

FIG. 3 is a side elevation view of an over-the-range hood according to an embodiment of the present invention, which is disposed over a gas range 312, FIGS. 4A to 4C are side views showing an extending operation of guide rods and wing plates according to FIG. 3, FIG. 5 is a schematic plan view of the over-the-range hood according to FIG. 3, and FIG. 6 is an exploded perspective view of coupling structures according to FIG. 3.

As first shown in FIG. 3, each of side plates 301 of outer panel 315 defining an external appearance of the over-the-range hood 300 is provided at a front portion of the side plates 301 with a guide rod 302 such that the guide rod 302 is rotatably supported by a pivot 304 provided at a front and lower position of the side plate 301. To prevent the guide rod 302 from rotating more than a certain angle, a stopper protrusion 307 is provided at the side plate 301 such that the stopper protrusion 307 is positioned at a location before and just below the pivot 304. A wing plate 303 is rotatably coupled to the guide rod 302 by a holding unit 306. The guide rod 302 is provided at an approximately middle portion of the guide rod with a stopper blade 302*a* to prevent the wing plate 303 from rotating beyond a certain position. FIG. 3 shows the wing plate 303 retracted on the side plate 301 of the over-the-range hood 300.

FIGS. 4A to 4C show an operation of forwardly extending the wing plate retracted in the over-the-range hood.

In FIG. 4A, the wing plate 303 is retracted on the side plate 301 of the over-the-range hood 300. When there is need to extend the wing plate 303, the guide rod 302 is pulled in a direction of an arched arrow, i.e., in a forward direction of the over-the-range hood 300 to a position, as shown in FIG. 4B. That is, the guide rod 302 is rotated forwardly by an angle of about 90° to be protruded from the over-the-range hood 300. Subsequently, the wing plate 303 is rotated about the guide rod 302 such that both the wing plates 303 are rotated toward each other to be substantially flush with each other. Therefore, after the rotation of the wing plate 303 about the guide rod 302, the wing plate 303 is in a position, as shown in FIG. 4C. With the wing plate 303 protruded forwardly and horizontally positioned, odors and undesired substances 311*b* generated from pots 309*b* placed on a front pair of top burners 310*b* as well as odors and undesired substances 311*a* generated from pots 309*a* placed on a rear pair of top burners 310*a* are prevented from rising vertically. At this point, the odors and the undesired substances 311 from the pots 309*a* and 309*b* positioned on the gas range part 310, as shown in FIG. 3, are introduced into the over-the-range hood 300 through an intake port 308 and then discharged to the outside of the room through an exhaust duct 305 by a suction force at the intake port 308, where the suction force is provided by the blower fan (not shown) in the over-the-range hood 300.

FIG. 5 shows the pair of wing plates 303, which are forwardly extended to be substantially flush with each other via the extending operation shown in FIG. 4, when viewed from above. In this state, in which the wing plates 303 are protruding forwardly, the wing plates 303 are positioned above the front pair of top burners.

With reference to FIG. 6, a coupling structure 304 of the side plate 301 and the guide rod 302, a coupling structure of the guide rod 302 and the wing plate 303, and a structure preventing over-rotation of the guide rod 302 and the wing plate 303, are described hereinbelow.

In the coupling structure of the guide rod 302 and the side plate 301 of the over-the-range hood 300, the guide rod 302 is provided at one end with an enlarged circular coupling portion 302*c*. The enlarged circular coupling portion 302*c* is centrally provided with a pivot hole formed thereat, through which a pivot bolt 304*a* passes. The side plate 301 is formed with a threaded hole 304*b* into which the pivot bolt 304*a* is screwed to provide the coupling structure 304. Alternatively, the side plate 301 may be formed with a plain hole and a nut may be provided at an inside of the side plate 301. The pivot bolt 304*a* may be provided with a plain shank portion, which is disposed between a head portion and a threaded portion of the bolt, so that the guide rod 302 can be freely rotated thereon.

To prevent the guide rod 302 pivotably coupled to the side plate 301 from rotating beyond a predetermined angular displacement, the side plate 301 is provided with a stopper protrusion 307. The stopper protrusion 307 may be positioned such that the guide rod 302 can be rotated by only a rotation angle of 90° to 100° from a vertical retracted position of the guide rod 302. When a rotation angle of the guide rod 302 is set to be slightly larger than the rotation angle of 90°, the wing plates 303 can function to guide odors, oil droplets and the like toward the intake port of the over-the-range hood 300.

The coupling structure rotatably holding the wing plate 303 on the guide rod 302 will now be described.

The wing plate 303 is attached at both ends of one side of the wing plate 303 with the holding unit 306, in which the guide rod 302 is rotatably held, so that the wing plate 303 can be rotated about the guide rod 302. As shown in FIG. 6, the holding units 306 are comprised of a bracket plate, which is adapted to be attached to the wing plate 303 by screws. The bracket plate has a U-shaped curved portion to receive the guide rod 302 therein. The guide rod 302 is provided at a middle portion of the guide rod 302 with a stopper blade 302*a*, which prevents over rotation of the wing plate 303, i.e., to prevent the wing plate 303 from rotating beyond a certain angular position. The wing plate 303 is formed with a cut portion 303*a* at a middle portion of one side of the wing plate, i.e., at a position corresponding to the stopper blade 302*a*. The cut portion 303*a* may be provided with a plate-shaped downward extension 303*b* to obtain a stable stopped state. An enlarged head 302*b* is provided preventing the wing plate 303 from being separated from the guide rod 302.

By the above-described coupling structures, a limited rotation of the guide rod 302 relative to the side plate 301, and a limited rotation of the wing plate 303 relative to the guide rod 302 are achievable. Consequently, the wing plate 303, which is positioned on the side plate 301 of the over-the-range hood 300 in a normal resting state, can be rotated and extended forwardly to prevent the rise, and thus diffusion, of odors and oil substances generated from the pots 309*a* and 309*b*, as shown in FIG. 3, disposed therebelow, if necessary.

Figure 7:
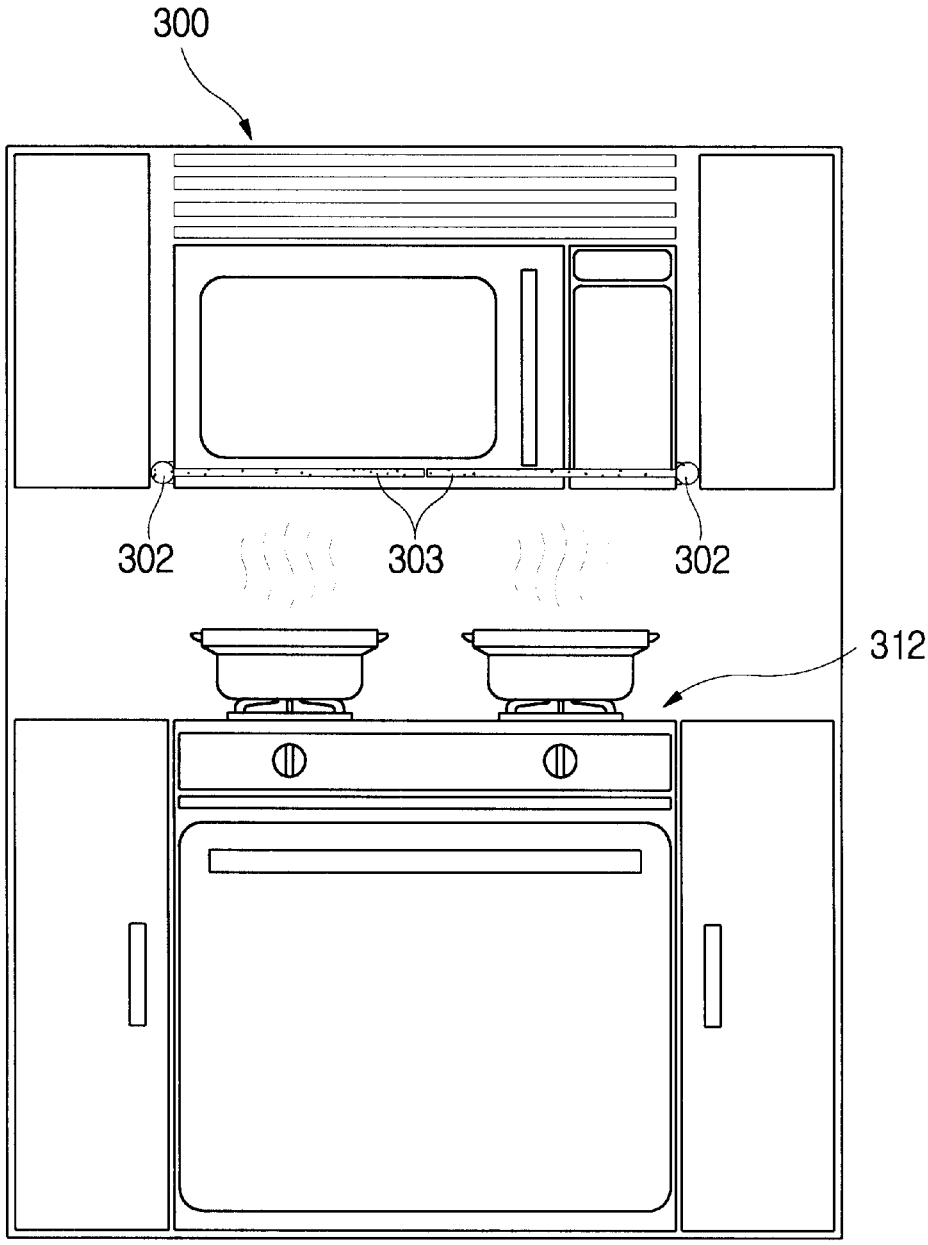
FIG. 7 is a front elevation view of the over-the-range hood according to FIG. 3.

FIG. 7 is a front elevation view of the over-the-range hood 300 according to FIG. 3 disposed above a gas range, in which a pair of wing plates 303 are extended forwardly from the over-the-range hood 300 at a time of cooking.

Figure 8:
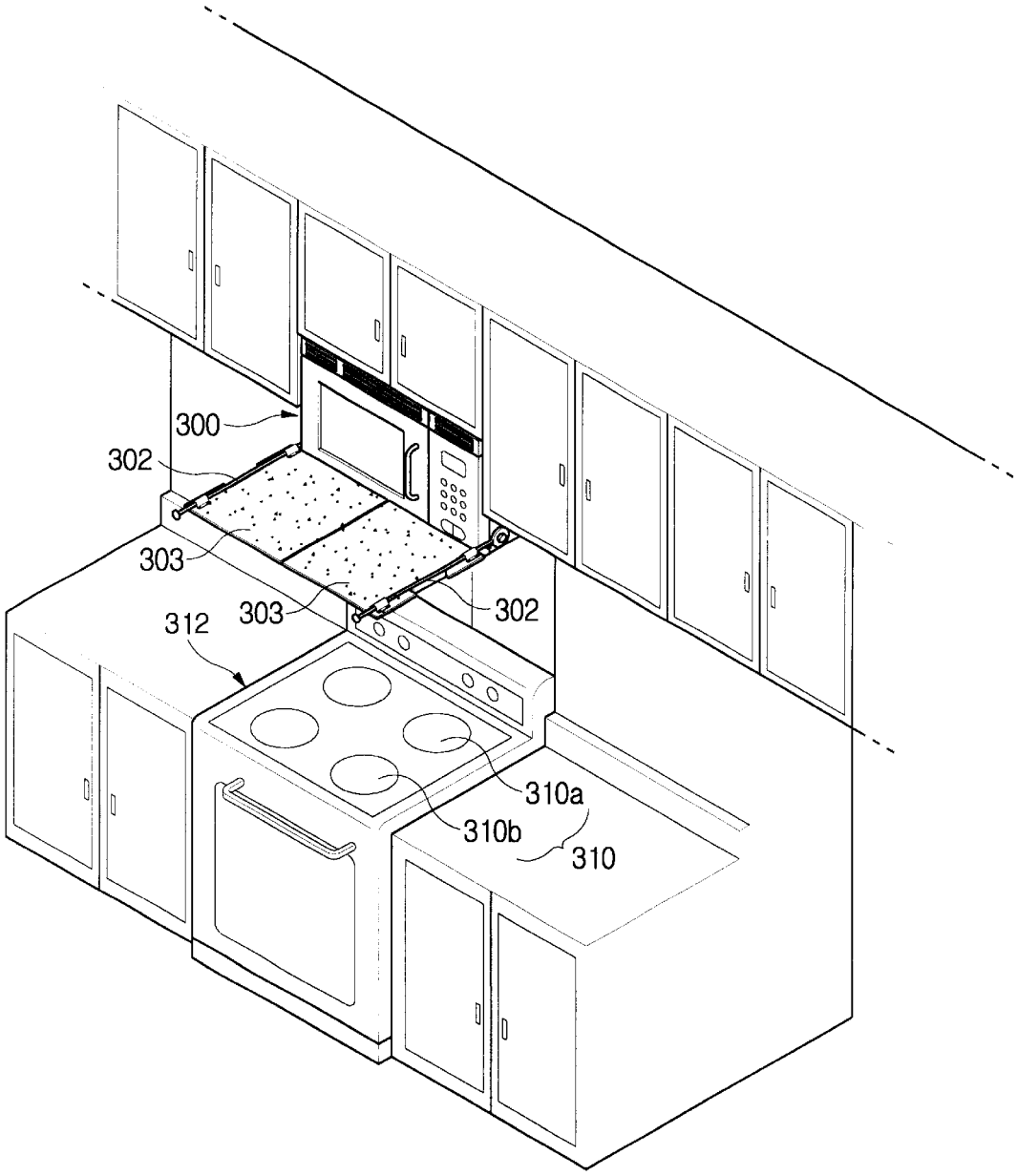
FIG. 8 is a perspective view of the over-the-range hood according to FIG. 3, which is installed in a finished kitchen.

FIG. 8 is a perspective view of the over-the-range hood according to FIG. 3, which is installed with kitchen cabinets, in which the wing plates 303 are also extended forwardly from the over-the-range hood at the time of cooking.

It will be appreciated that the coupling structures and the rotation limiting structures can be alternatively embodied in various manners different from the above description.

As described above, an over-the-range hood is equipped on each side with a pair of wing plates, which are extended forwardly at the time of cooking to prevent odors, oil droplets and the like from rising and thus diffusing into the room and to guide them toward an intake port of the over-the-range hood, thereby maintaining pleasant room air. In a normal resting state, each of the pair of wing plates is retracted to respective sides of the over-the-range hood and maintained thereto, thereby enabling a kitchen space to be efficiently used.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An over-the-range hood adapted to discharge odors and undesired substances generated by a gas range to an outside at the time of cooking, comprising:

a holding unit;

a pair of guide rods coupled to respective side plates of the over-the-range hood by a pivot to be rotated forwardly; and a pair of wing plates connected to the pair of guide rods respectively, and adapted to be rotated toward each other about the pair of guide rods by the holding unit.

2. The over-the-range hood as set forth in claim 1, further comprising;

a rotation-limiting unit limiting a rotation angle of the pair of guide rods to prevent the guide rods from rotating beyond a predetermined angular position.

3. The over-the-range hood as set forth in claim 2, wherein the rotation limiting unit further comprises a pair of protrusions, each one of the pair of the protrusions is provided on a side plate of the over-the-range hood at a position intersecting a plane defined by rotation of one of the guide rods.

4. The over-the-range hood as set forth in claim 2, wherein the rotation-limiting unit is positioned such that the pair of guide rods are rotated by a rotation angle of about 90° to 100° with respect to a front of the range hood.

5. The over-the-range hood as set forth in claim 1, further comprising:

a rotation-limiting unit limiting a rotation angle of the pair of wing plates to prevent the wing plates from rotating beyond a predetermined angular position.

6. The over-the-range hood as set forth in claim 5, wherein the rotation-limiting unit limits the rotation angle of the wing plates to an angle of about 90°.

7. The over-the-range hood as set forth in claim 1, wherein the pair of wing plates rotates into a position in which the wing plates are substantially flush with each other.

8. The over-the-range hood as set forth in claim 7, wherein the pair of guide rods rotate past a position parallel to the gas range such that the discharge odors and undesired substances generated by the gas range are guided by the wing plates into the over-the-range hood.

9. A range hood to discharge odors and undesired substances generated by cooking using a range to an outside of a room, comprising:

a holding unit;

a pair of guide rods pivotally coupled to respective sides of the range hood to extend the guide rods above the range;

a pair of wing plates connected to the pair of guide rods respectively, and rotatable toward each other about the pair of guide rods by the holding unit, and with the wing plates extended above the range and rotated toward each other, the odors and the undesired substances generated by cooking can be discharged to the outside of the room.

10. The range hood as set forth in claim 9, wherein the pair of wing plates rotates into a position in which the wing plates are substantially flush with each other.

11. The range hood as set forth in claim 9, wherein the pair of wing plates protrude forwardly and are positioned above a pair of front burners of the range.

12. The range hood as set forth in claim 9, wherein the pair of wing plates protrude forwardly and are positioned above a pair of front burners of the range.

13. The range hood as set forth in claim 9, further comprising:

a coupling structure including an enlarged circular coupling portion with a pivot hole formed therein and a pivot bolt to pivotally couple the pair of guide rods to respective sides of the range hood.

14. The range hood as set forth in claim 9, further comprising:

a coupling structure including a hole formed in the respective sides of the range hood, a nut provided on an inside of each of the respective sides of the range hood, and a pivot bolt with a plain shank portion disposed between a head portion and a thread portion of the pivot bolt.

15. The range hood as set forth in claim 9, further comprising;

a rotation-limiting unit to limit a rotation angle of the pair of guide rods beyond a predetermined angular position.

16. The range hood as set forth in claim 15, wherein the rotation-limiting unit further comprises:

a pair of protrusions, each one of the pair of the protrusions is provided on a side of the range hood at a position intersecting a plane defined by a rotation of one of the guide rods.

17. The range hood as set forth in claim 15, wherein the rotation-limiting unit is positioned such that the pair of guide rods is rotatable to the rotation angle of about 90° to 100° with respect to a front of the range hood.

18. The range hood as set forth in claim 9, further comprising:

a rotation-limiting unit to limit a rotation angle of the pair of wing plates to prevent the wing plates from rotating beyond a predetermined angular position.

19. The range hood as set forth in claim 18, wherein the rotation-limiting unit is adapted to limit the rotation angle of the wing plates to an angle of about 90° with respect to a front face of the range hood.

20. The range hood as set forth in claim 10, wherein the pair of guide rods rotate past a position parallel to the range such that the discharge odors and undesired substances generated by the range are guided by the wing plates into the range hood.

21. The range hood as set forth in claim 18, wherein the rotation-limiting unit is a stopper blade provided on a middle portion of each of the guide rods corresponding to a cut portion at a middle portion of each of one side of a respective wing plate to prevent the wing plate from rotating beyond the predetermined angular position.

22. The range hood as set forth in claim 18, wherein each cut portion is provided with a plate-shaped extension.

23. The range hood as set forth in claim 9, wherein each of the pair of wing plates includes an enlarged head preventing the wing plates from separating from the pair of guide rods, respectively.

* * * * *